US005295559A

United States Patent [19]

Nutkins

[11] Patent Number: 5,295,559

[45] Date of Patent: Mar. 22, 1994

[54] REVERSIBLE FRICTIONAL BRAKE FOR USE WITH ROPE OR THE LIKE

[76] Inventor: Larry L. Nutkins, 71 York Ct., Kissimmee, Fla. 34758

[21] Appl. No.: 886,826

[22] Filed: May 22, 1992

[51] Int. Cl.[5] ..... B65H 59/14

[52] U.S. Cl. ..... 188/65.4; 188/65.5; 182/191

[58] Field of Search ..... 188/65.1, 65.2, 65.3, 188/65.4, 65.5; 182/5, 6, 7, 71, 190, 191, 192

[56] References Cited

U.S. PATENT DOCUMENTS

| | | | |
|---|---|---|---|
| 556,099 | 3/1896 | Kingsbury | 188/65.5 |
| 688,592 | 12/1901 | Chadwick | 182/6 |
| 4,054,183 | 10/1977 | Boniface | 188/65.4 X |
| 4,311,218 | 1/1982 | Steffen | 188/65.4 |
| 5,145,036 | 9/1992 | Omalia | 188/65.5 |

FOREIGN PATENT DOCUMENTS

| | | | |
|---|---|---|---|
| 11765 | of 1899 | United Kingdom | 188/65.4 |

*Primary Examiner*—Robert J. Oberleitner
*Assistant Examiner*—Kevin D. Rutherford
*Attorney, Agent, or Firm*—Paul S. Rooy

[57] ABSTRACT

A reversible frictional brake for use with rope or the like is disclosed comprising a brake section rotatably attached to a housing. Rope is threaded between rollers, end links, snap links and an axle in the brake section. The reversible frictional brake for use with rope or the like is suspended by means of a loop attached to the housing. The frictional relationship between the rope and the rollers, end links, snap links and axle brake the travel of the rope through the brake section, thereby allowing a single rope handler to lower heavy weights and individuals attached to the rope in a controlled fashion. After a lowering operation, the brake housing may be simply rotated relative to the housing, thereby readying the reversible frictional brake for use with rope or the like for the next lowering operation.

14 Claims, 6 Drawing Sheets

FIG 1
PRIOR ART
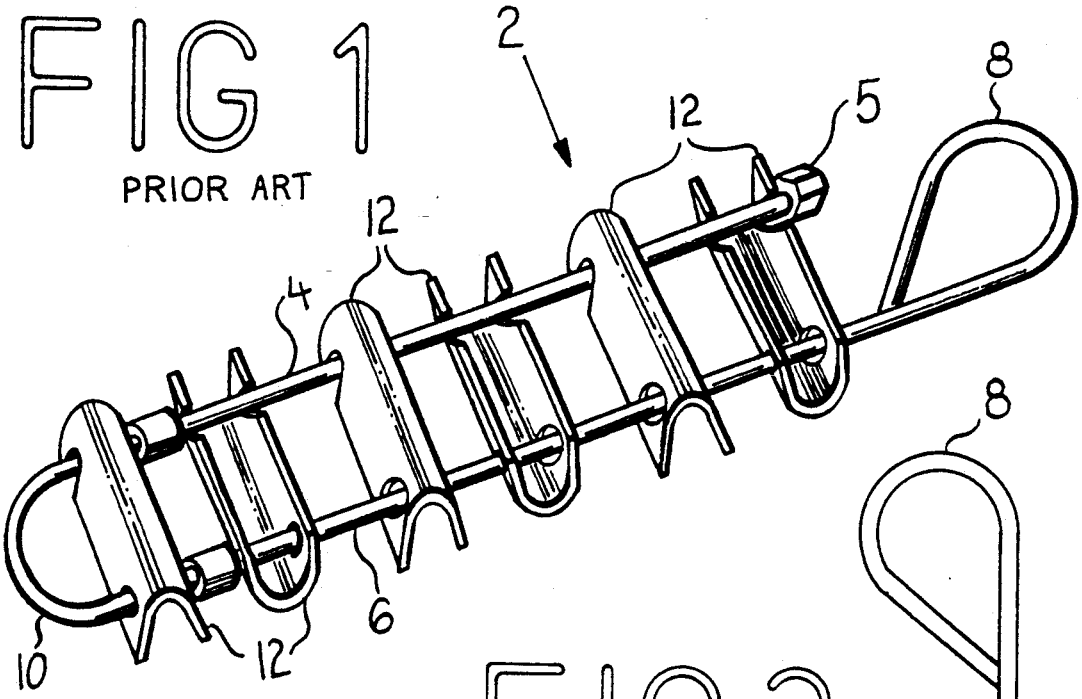
FIG 2
PRIOR ART
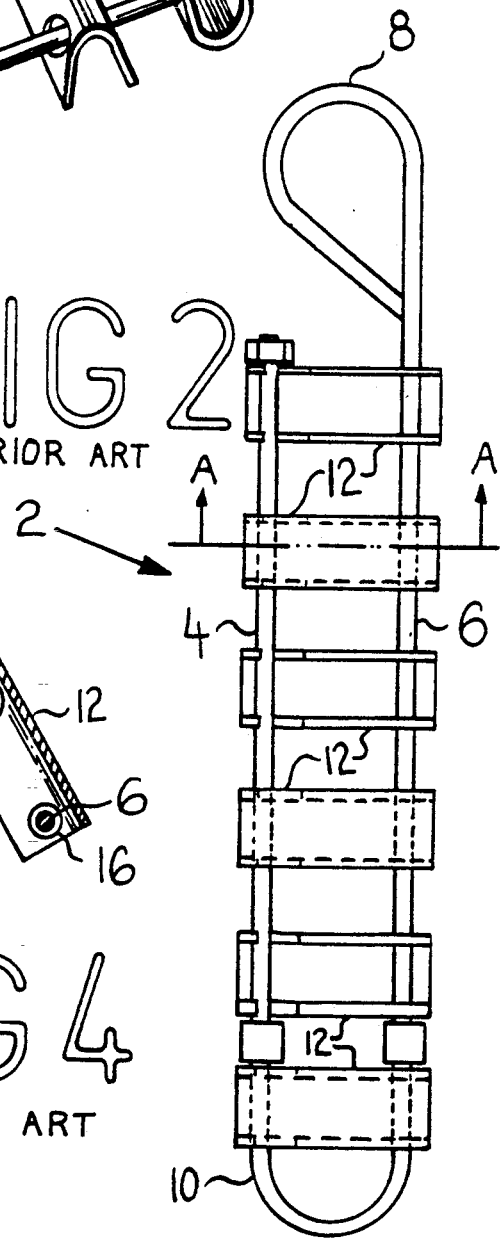
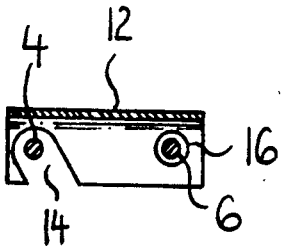
FIG 3
SECT. A-A
PRIOR ART
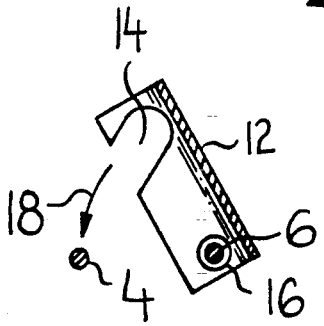
FIG 4
PRIOR ART FIG 5
PRIOR ART
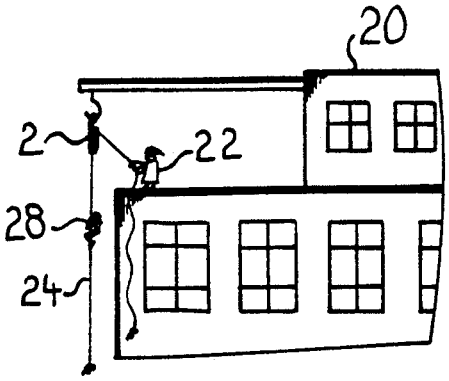
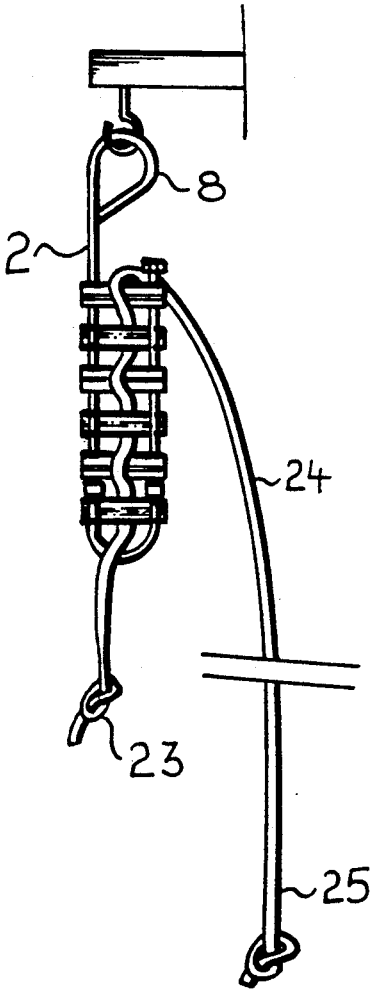
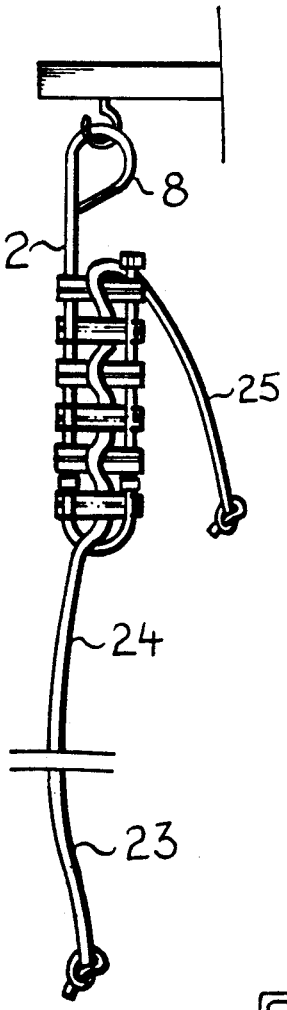
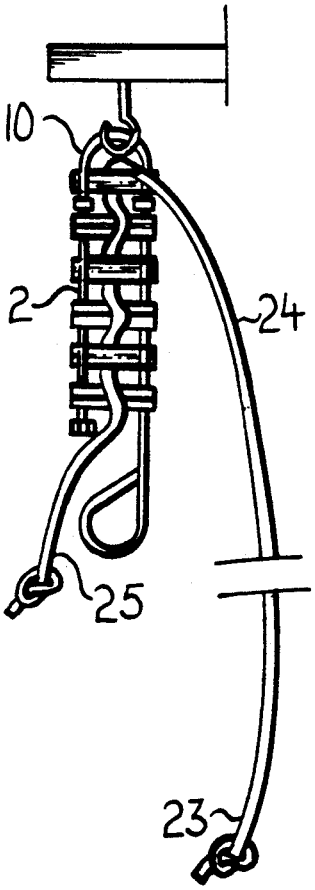
FIG 6
PRIOR ART
FIG 7
PRIOR ART
FIG 8
PRIOR ART

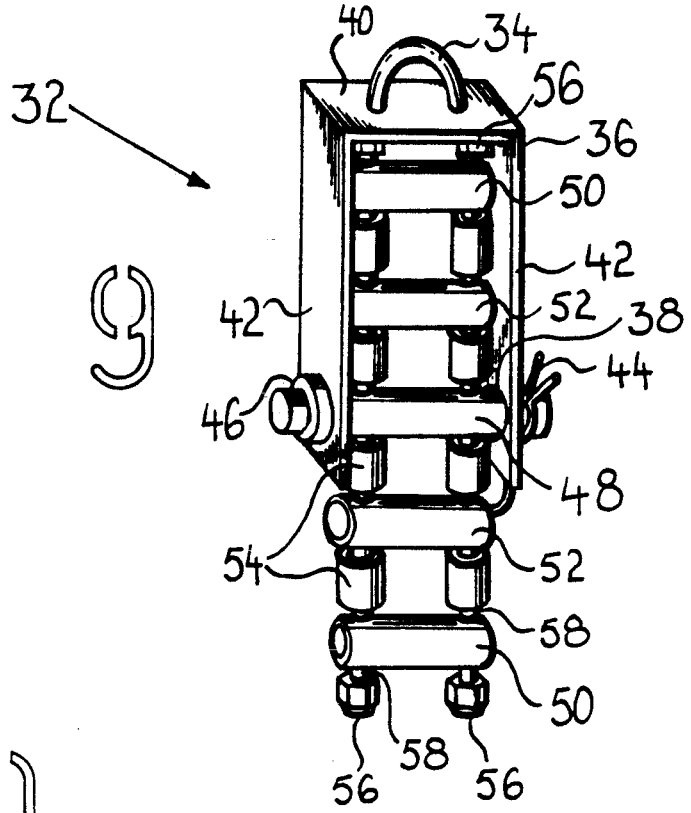
FIG 9
FIG 10
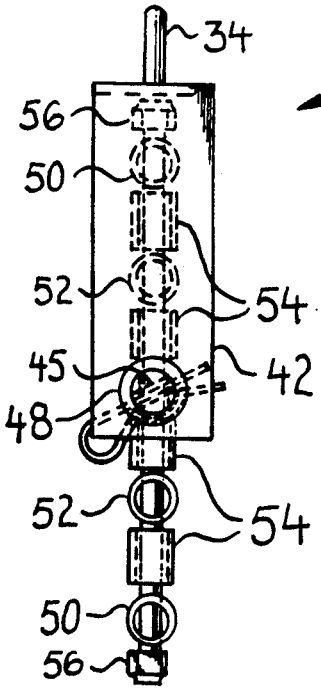
FIG 11
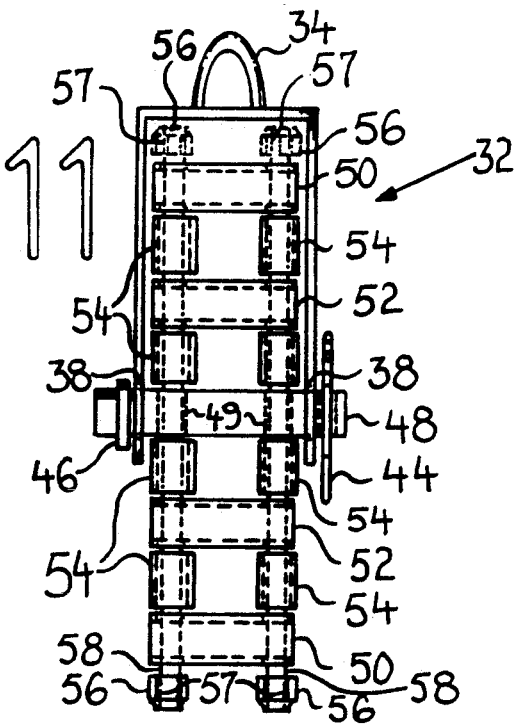

FIG 12
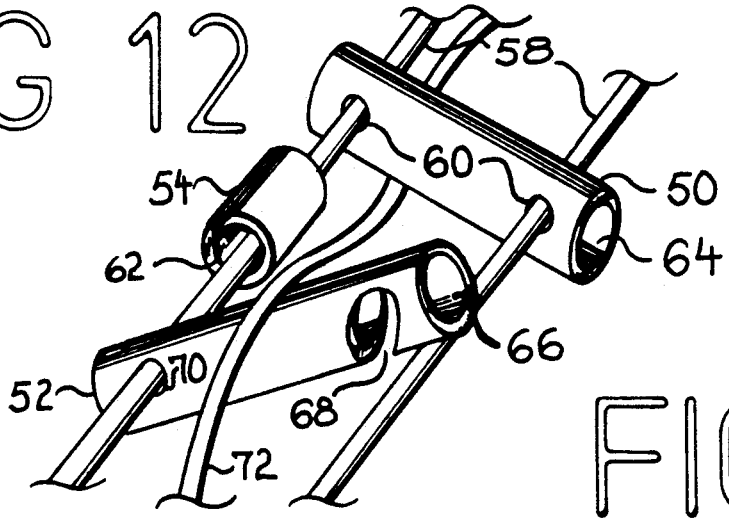
FIG 15
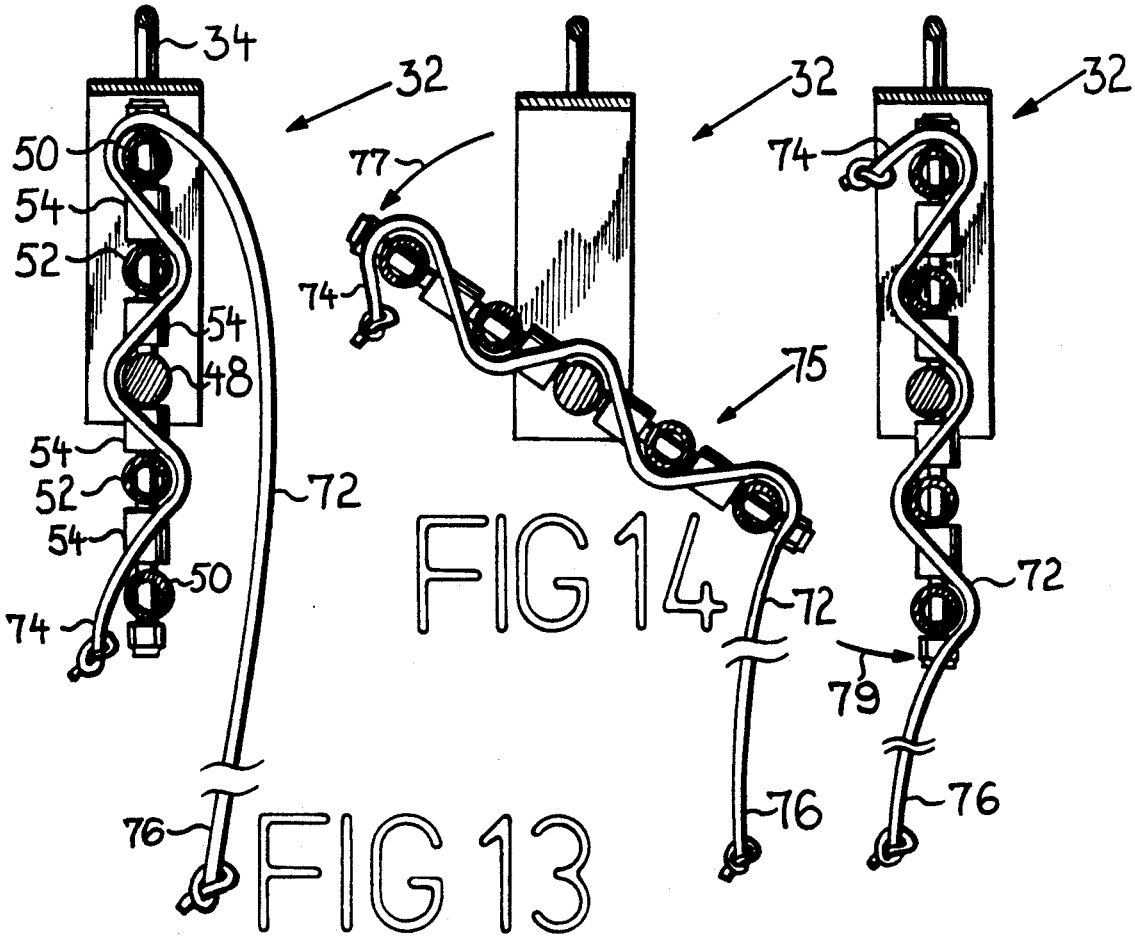
FIG 14
FIG 13

FIG 16
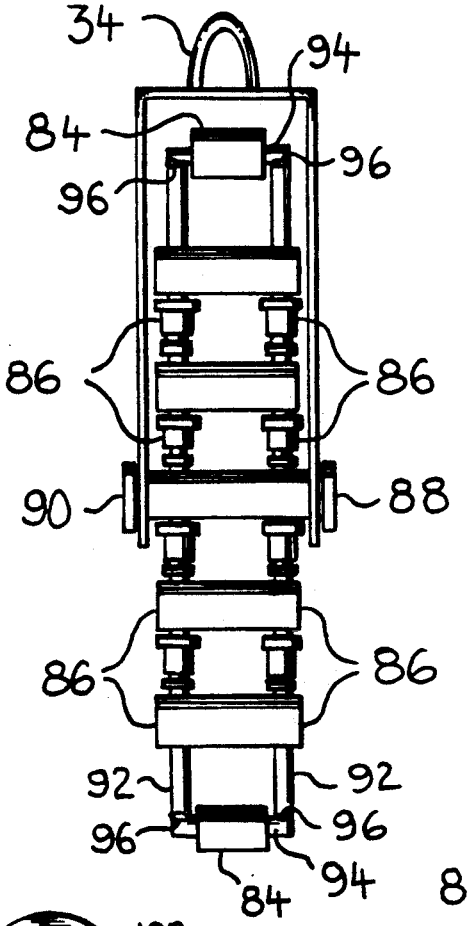
FIG 17
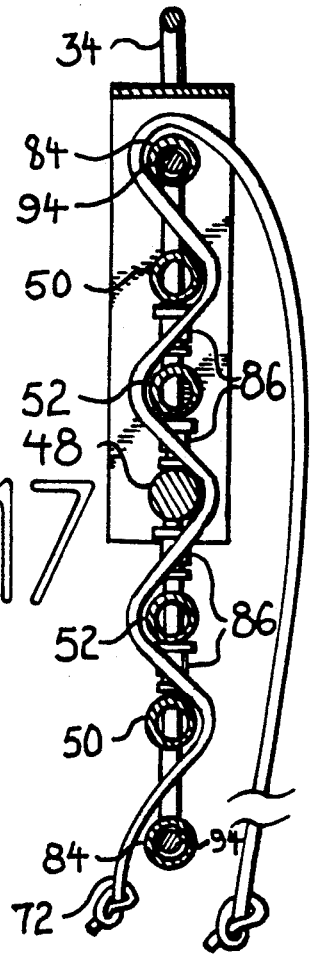
FIG 19
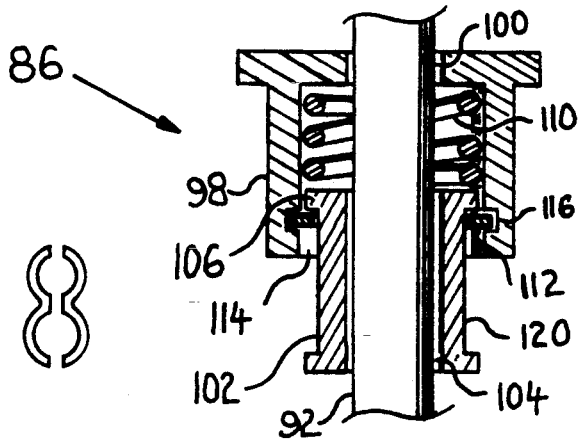
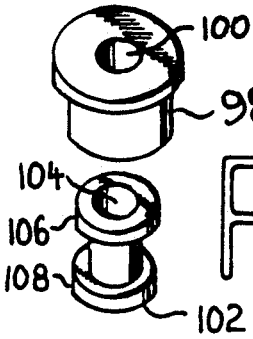
FIG 18

REVERSIBLE FRICTIONAL BRAKE FOR USE WITH ROPE OR THE LIKE

FIELD OF THE INVENTION

The present invention relates to devices for handling rope or the like and in particular to a reversible frictional brake for use with rope or the like.

BACKGROUND OF THE INVENTION

Along with the invention of the wheel, the invention of rope constitutes one of the most useful and significant technical advances in the history of mankind.

Rope makes possible the performance of myriad tasks previously impossible: lowering anchors to the seabed to moor ships, raising and lowering heavy objects on land, those aspects of alpine sports and cave climbing which require ropes, civilian and military rappels, rescue activities where individuals must be lowered to safety, etc.

A requirement common to many of these activities is the ability of the rope handler to govern the speed of descent of an individual or heavy object attached to the rope he is handling.

Frictional brakes for use with rope or the like have been developed to aid the rope handler in lowering a heavy object. On ships the anchor line is wound around a capstan barrel several times so that when the rope is held taut around a rotating capstan, the rope is taken in or let out by virtue of the friction between the rope and the capstan barrel.

The bar rack was developed to provide a smaller and more portable frictional rope brake. Referring to FIGS. 1–8 we can observe a bar rack 2 and its method of operation.

FIG. 1 is a front isometric view of bar rack 2, comprised of links 12 free to slide along loop rod 6 and threaded rod 4. The links 12 are constrained at one end by nut 5 threaded onto threaded rod 4 and loop 8, and at the other end by half circle 10.

FIG. 2 is a front plan view of bar rack 2.

FIG. 3 is a cross sectional view of a link 12 taken at section A—A of FIG. 2. Link 12 has holes 16 through which loop rod 6 passes and slot 14 which frictionally admits threaded rod 4.

FIG. 4 illustrates how link 12 may rotate about loop rod 6 in order to facilitate the installation of a rope 24 in bar rack 2 as depicted in FIGS. 6–8. Link 12 may be re-engaged with threaded rod 4 by rotating link 12 about loop rod 6 as shown by arrow 18 and frictionally snapping threaded rod 4 into slot 14.

FIG. 5 illustrates a typical use scenario for bar rack 2. Rope handler 22 has installed rope 24 into bar rack 2 and is lowering an individual being rescued 28 off building 20.

FIGS. 6–8 show how bar rack 2 is positioned during a lowering operation and then re-positioned so as to be ready for use in the next lowering operation.

FIG. 6 depicts bar rack 2 ready to be used for the first lowering operation: rope 24 is installed on bar rack 2; bar rack 2 is suspended by means of loop 8. The object to be lowered would be attached to rope end 23 and the rope handler would grasp the part of rope 24 having rope end 25.

The rope handler now allows rope 24 to travel through bar rack 2 until we have the situation depicted in FIG. 7: assuming a long enough rope 24, the object being lowered attached to rope end 23 is now at the desired height and little rope remains between bar rack 2 and rope end 25. The weight attached to rope end 23 may now be removed and bar rack 2 readied for the next lowering operation.

In order to lower the next weight, bar rack 2 must be rotated end for end and suspended by means of half circle 10 as depicted in FIG. 8 . A new weight to be lowered may now be attached to rope end 25, and the rope handler grasps that portion of rope 24 having rope end 23 and allows rope end 25 to descend by permitting rope 24 to travel through bar rack 2 as before.

A number of problems exist associated with using the bar rack for a series of lowering operations.

First, between uses, the rope handler must detach bar rack loop 8 from its attach point, rotate bar rack 2 end for end, and then attach half circle 10 to the attach point. In a fire rescue situation where seconds count this delay may be costly.

Second, wherever handling is involved, the danger of dropping the item being handled exists. If the rope handler were to drop the bar rack, further delays would occur, not to mention the hazard to individuals below.

Third, it may be physically impossible for the rope handler to rotate the bar rack due to the combined weight of the bar rack and rope—1000 feet of rope can weigh over 150 pounds.

Fourth, when bar rack 2 is suspended by means of half circle 10 as depicted in FIG. 8, the danger exists that one or more links 12 may become disengaged from threaded rod 4 due to rope movement. This link disengagement would constitute a catastrophic failure of the bar rack if all links were to snap free: the individual being rescued 28 would free fall down to the surface below. In the case of a high rise building fire rescue operation this fall could be fatal.

Finally, no provision exists in the bar rack design to quickly and automatically adjust the amount of friction imparted the rope by the bar rack: lowering a heavy weight requires more effort from the rope handler than a light weight. The work associated with lowering a series of heavy people to safety combined with the added chore of having to lift the bar rack, rotate it end for end, and then re-suspend between each lowering operation contributes to rope handler fatigue, the possibility of error, and may place the outcome of the rescue in jeopardy.

SUMMARY OF THE INVENTION

Accordingly, it is an object of this invention to provide a reversible frictional brake for use with rope or the like comprising the feature of being able to rotate the brake section of said reversible frictional brake for use with rope or the like, thereby affording the benefit of being able to be used successively without the delay of detaching, rotating and then re-attaching the brake.

Another benefit associated with the instant invention's reversibility is the elimination of the danger of dropping the reversible frictional brake for use with rope or the like in handling.

Still another benefit deriving from the instant invention's reversibility is that the reversible frictional brake for use with rope or the like may be reversed for successive uses regardless of the weight of the rope being used, thereby rendering the present invention more functional than the currently available bar racks.

It is another object of this invention to provide a reversible frictional brake for use with rope or the like featuring non-disengaging end links at each end of the brake section, thereby reducing the likelyhood of the rope becoming disengaged from the reversible frictional brake for use with rope or the like. This feature affords the benefit that an individual being rescued stands a smaller chance of winding up in free fall than if he were being rescued using the currently available bar racks.

It is still a further object of this invention to provide a reversible frictional brake for use with rope or the like with automatic rope friction adjustment. The design feature which would allow the accomplishment of this object would be spring loaded spacers separating the links, thereby yielding the benefit of reduced rope handler fatigue and consequent reduced risk of rope handler error.

It is still a further object of this invention to provide a reversible frictional brake for use with rope or the like manufactured of readily available materials, thereby yielding the advantage of being affordable.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIGS. 1, 2, 3 and 4. Sheet two contains FIGS. 5, 6, 7 and 8. Sheet three contains FIGS. 9, 10 and 11. Sheet four contains FIGS. 12, 13, 14 and 15. Sheet five contains FIGS. 16, 17, 18 and 19. Sheet six contains FIGS. 20 and 21.

FIGS. 1–8 depict the form and mode of use of a bar rack, and are explained in the BACKGROUND OF THE INVENTION section.

FIG. 9 is a front isometric view of the reversible frictional brake for use with rope or the like.

FIG. 10 is a side view of the reversible frictional brake for use with rope or the like.

FIG. 11 is a front view of the reversible frictional brake for use with rope or the like.

FIG. 12 is a front isometric view of a snap link, an end link and a spacer installed on the threaded rods.

FIGS. 13–15 are cross sectional side views showing the method of using the reversible frictional brake for use with rope or the like during repeated lowering operations.

FIG. 16 is a front view of an alternate embodiment of the reversible frictional brake for use with rope or the like.

FIG. 17 is a cross sectional side view of the alternate embodiment of the reversible frictional brake for use with rope or the like.

FIG. 18 is a front isometric view of a spring loaded spacer.

FIG. 19 is a cross sectional view of a spring loaded spacer.

DETAILED DESCRIPTION OF THE PREFERRED EMBODIMENT

Figure 20:
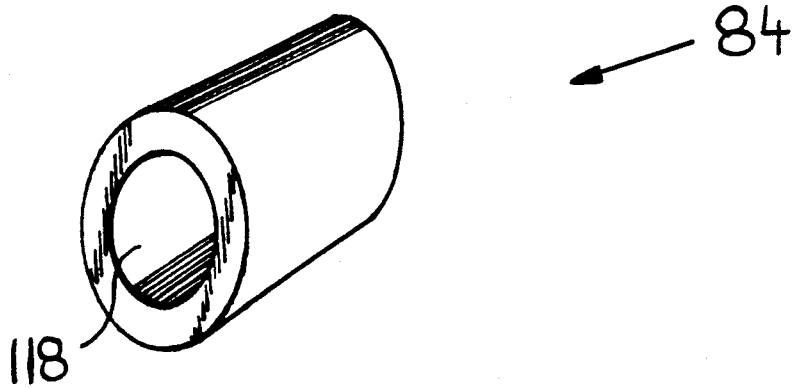
FIG. 20 is a front isometric view of a roller.

Referring now to FIGS. 9–11 we can observe reversible frictional brake for use with rope or the like 32. Housing 36 comprises housing legs 42 and loop 34 attached at right angles to housing base 40. Each housing leg 42 has a housing leg hole 38 at the end opposite housing base 40.

Axle 48 fits through and is free to rotate within housing leg holes 38. Axle 48 is constrained within housing leg holes 38 by axle head 46 at one extreme and cotter pin 44 at the other. Cotter pin 44 passes through cotter pin hole 45 in axle 48.

End links 50, snap links 52, spacers 54 and axle 48 are constrained on threaded rods 58 by means of locknuts 56 threaded onto the threads 57 located at each end of threaded rods 58. Threaded rods 58 are installed through axle holes 49 in axle 48.

Referring to FIG. 12 we can observe end link 50 is a hollow cylinder having axial end link bore 64 and radial end link holes 60 through which threaded rods 58 are free to slide.

Spacer 54 is a hollow cylinder having axial spacer bore 62 through which a threaded rod 58 is free to slide.

Snap link 52 is a hollow cylinder having axial snap link bore 66 and radial snap link holes 70 through which a threaded rod 58 is free to slide. At the extreme of snap link 52 opposite snap link holes 70 is snap link slot 68, sized and positioned so as to frictionally admit the threaded rod 58 which is not disposed within snap link holes 70.

Rope 72 is threaded around end links 50, snap links 52 and axle 48 so as to urge threaded rod 58 into snap link slot 68 when rope 72 is taut.

FIGS. 13–15 are cross sectional side views of reversible frictional brake for use with rope or the like 32 after being used for a lowering operation (FIG. 13), then being repositioned to be used for a subsequent lowering operation (FIG. 14) and in position to be used for a subsequent lowering operation (FIG. 15).

In FIG. 13 a weight was attached to second rope end 76. The rope handler grasped that part of the rope having first rope end 74 and allowed rope 72 to migrate through reversible frictional brake for use with rope or the like 32, thereby lowering the weight attached to second rope end 76.

The friction between rope 72 and end links 50, snap links 52 and axle 48 braked the descent of first rope end 74 so that the rope handler was required to exert only minimal force to control the descent of first rope end 74.

The axial dimension of spacers 54 may be varied to accommodate different sizes of rope. For example, it has been determined experimentally that spacers having an axial measurement of $\frac{3}{4}$ inch work well with $\frac{5}{8}$ inch diameter rope; spacers having an axial measurement of 1 inch work well with a $\frac{7}{8}$ inch diameter rope, etc.

FIGS. 14 and 15 show brake section 75 being rotated into position to be used in a subsequent lowering operation as indicated by arrows 77 and 79. Brake section 75 is comprised of threaded rods 58, locknuts 56, end links 50, snap links 52, axle 48 and spacers 54.

FIG. 15 shows reversible frictional brake for use with rope or the like 32 in position to be used in a subsequent lowering operation. A weight to be lowered may now be attached to first rope end 74. The rope handler grasps that part of the rope having second rope end 76 and controls the descent of first rope end 74.

Once the weight attached to first rope end 74 has been lowered, brake section 75 may be rotated back into the position shown in FIG. 13 for re-use. In this manner the reversible frictional brake for use with rope or the like 32 may be used for an indefinite number of lowering operations without having to remove and re-install reversible frictional brake for use with rope or the like 32 on its attach point.

FIG. 16 depicts three features which may be used in alternate embodiments of the instant invention. End rods 94 may be inserted through rollers 84 and welded to the ends of rods 92 at welds 96, thereby providing a stronger and more rigid structure. As may be seen in FIG. 20, rollers 84 are hollow cylinders having axial roller bore 118 sized to admit non-frictional passage to end rod 94.

Housing 36 may be constrained on axle 48 by means of a machined axle head 90 at one end of axle 48, and a welded axle head 88 at the other. A more compact and space conserving design is achieved in this fashion.

Finally, spacers 54 may be replaced with spring loaded spacers 86 in order to provide a reversible frictional brake for use with rope or the like which automatically adjusts the amount of friction between rope 72 and end links 50, snap links 52 and axle 48 according to the size of the weight being lowered.

FIG. 17 shows how rope 72 is installed on an alternate embodiment of a reversible frictional brake for use with rope or the like having rollers 84.

FIG. 18 is an isometric front view of cylinder 98 and piston 102, both components of spring loaded spacer 86. Piston 102 has axial piston bore 104, piston upper lip 106 and piston lower lip 108. Cylinder 98 has axial cylinder upper bore 100.

FIG. 19 is a cross sectional view of spring loaded spacer 86. Cylinder upper bore 100 is sized to freely admit rod 92, as is piston bore 104. The diameter of piston upper lip 106 is sized to freely slide into cylinder lower bore 114.

Snap ring 112 is sized to fit loosely around piston saddle 120. When snap ring 112 is held in close proximity to piston saddle 20, snap ring 112 may be pushed through cylinder lower bore 114 far enough to spring into snap ring groove 116, thereby holding part of piston 102 within cylinder lower bore 114 against spring 110. Spring 110 is sized to fit within cylinder lower bore 114 and around rod 92.

Figure 21:
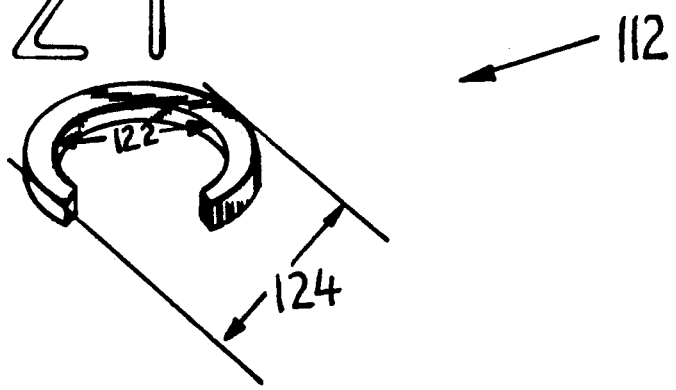
FIG. 21 is a front isometric view of a snap ring.

FIG. 21 is a front isometric view of snap ring 112. Snap ring inside diameter 122 is less than the diameter of piston upper lip 106. Snap ring outside diameter 124 is sized to engage in snap ring groove 116.

Rod 92 is free to slide through spring loaded spacer 86 (that is to say through cylinder upper bore 100, spring 110 and piston bore 104).

The stiffness of spring 110 may be varied so as to allow the reversible frictional brake for use with rope or the like 32 to provide optimum braking while in use.

All components of the instant invention may be fabricated from stainless steel or other appropriate material. Methods of component fabrication may include machining, forming, welding and other appropriate operations. Commercially available stainless steel rod may be used for rods 92 and end rods 94; commercially available stainless steel tube may be used for spacers 54, snap links 52, end links 50 and rollers 84. Locknuts 56 may be commercially available aviation type locknuts with nylon inserts. Cotter pin 44 may be a commercially available cotter pin.

While a preferred embodiment of the invention has been illustrated herein, it is to be understood that changes and variations may be made by those skilled in the art without departing from the spirit and scope of the appending claims.

I claim:

1. A reversible frictional brake comprising a housing and a brake section rotatably attached to said housing, said brake section comprising:
- an axle,
- a pair of parallel rods passing through said axle by means of axle holes, one axle hole being disposed at each end of said axle diametrical to said axle,
- an end link slideably attached to each pair of rod ends,
- a plurality of snap links disposed between said end links, each said snap link having snap link holes at one end through which one said parallel rod passes, and a snap link slot at the other end through which the other said parallel rod passes, and
- spacers between said end links, snap links and axle.

2. The reversible frictional brake of claim 1 wherein said snap links are cylinders.

3. The reversible frictional brake of claim 2 wherein said snap links are hollow cylinders having an axial snap link bore, said snap link holes being sized to freely admit passage to one said parallel rod, said snap link slot being sized and disposed so as to frictionally engage the other said parallel rod.

4. The reversible frictional brake of claim 3 wherein said spacers are hollow cylinders, each having a spacer bore which freely allows passage to one said parallel rods.

5. The reversible frictional brake of claim 4 wherein:
- said end links are hollow cylinders, each having diametrically disposed end link holes at each end sized to freely admit passage to one said rods, and
- each said parallel rod has a thread at both ends, and
- a locknut sized to fit the rod threads is threaded onto each said rod thread, thereby constraining said snap links, axle and spacers between said end links.

6. The reversible frictional brake of claim 5 wherein said housing comprises:
- a housing base,
- a pair of parallel housing legs, one said housing leg being rigidly attached at a right angle to one side of said housing base, the other said housing leg being rigidly attached at a right angle to the opposite side of said housing base,
- a loop attached to said housing base, and
- a housing leg hole sized to freely admit passage to said axle disposed in each said housing leg at the end of each said housing leg opposite said housing base.

7. The reversible frictional brake of claim 6 wherein said axle is a cylinder passing through both said housing leg holes, said axle being constrained within said housing leg holes by an axle head at one end and a cotter pin passing through a diametrically disposed cotter pin hole at the other end.

8. The reversible frictional brake of claim 1 wherein said spacers are spring loaded spacers comprising:
- a cylinder having a cylinder lower bore axially disposed within said cylinder,
- a spring within said cylinder lower bore, and
- a piston, part of which is disposed within said cylinder lower bore.

9. The reversible frictional brake of claim 8 further comprising:
- a cylinder upper bore axially disposed in said cylinder sized to freely admit passage to one said rod,
- said spring being a coil spring sized to freely fit around one said rod, and a piston bore axially disposed in said piston, said piston bore being sized so as to freely admit passage to one said rod.

10. The reversible frictional brake of claim 9 wherein part of said piston is constrained within said cylinder lower bore by means of:

a snap ring groove in said cylinder lower bore, a snap ring encircling a piston saddle, the outside diameter of said snap ring being engaged in said snap ring groove, and a piston upper lip sandwiched between said spring and said snap ring, the diameter of said piston upper lip being sized so as to allow said piston upper lip to freely slide within said cylinder lower bore, the diameter of said piston saddle being less than the diameter of said piston upper lip, the inside diameter of said snap ring being less than the diameter of said piston upper lip.

11. The reversible frictional brake of claim 6 wherein said axle is a cylinder passing through both said housing leg holes, said axle being constrained within said housing leg holes by a machined axle head at one end and a welded axle head at the other.

12. The reversible frictional brake of claim 1 wherein the means of slideably attaching said end links to said rods comprises:

end link holes diametrically disposed at each end of said end links, each said end link hole freely admitting passage to one said rod, and an end rod passing through a roller, one end of said end rod being rigidly attached to one rod end of said pair of parallel rod ends, the other end of said end rod being rigidly attached to the other rod end of said pair of rod ends.

13. The reversible frictional brake of claim of claim 12 wherein said roller is a hollow cylinder having an axial roller bore sized to freely admit passage to one said end rod.

14. The reversible frictional brake of claim 13 wherein the means of rigidly attaching said end rods to said rods is welding.

* * * * *

UNITED STATES PATENT AND TRADEMARK OFFICE

CERTIFICATE OF CORRECTION

PATENT NO. : 5,295,559

DATED : 3/22/1994

INVENTOR(S) : Larry L. Nutkins

It is certified that error appears in the above-identified patent and that said Letters Patent is hereby corrected as shown below:

Column 5, Line 35: "...piston saddle 20..." should be "...piston saddle 120..."

Signed and Sealed this

Thirtieth Day of August, 1994

*Attest:*

*Attesting Officer*

Bruce Lehman

BRUCE LEHMAN

*Commissioner of Patents and Trademarks*